United States Patent [19]

Rolf et al.

[11] 4,456,517

[45] Jun. 26, 1984

[54] METAL SPRING STUB AND CERAMIC BODY ELECTRODE ASSEMBLY

[75] Inventors: Richard L. Rolf, New Kensington; Maurice L. Sharp, Avonmore, both of Pa.

[73] Assignee: Aluminum Company of America, Pittsburgh, Pa.

[21] Appl. No.: 451,069

[22] Filed: Dec. 20, 1982

[51] Int. Cl.[3] ..... C25C 7/02; C25B 11/04; C25D 17/12

[52] U.S. Cl. ..... 204/286; 204/291; 204/297 R

[58] Field of Search ..... 204/288, 289, 286, 297 R, 204/291

[56] References Cited

FOREIGN PATENT DOCUMENTS 278964 4/1967 Austria ..... 204/286
390193 11/1973 U.S.S.R. ..... 204/297 R

*Primary Examiner*—Howard S. Williams
*Assistant Examiner*—T. L. Williams
*Attorney, Agent, or Firm*—Max L. Williamson

[57] ABSTRACT

An electrode assembly comprising an electrically conductive ceramic electrode body having an opening therein and a metal stub retained in the opening with at least a surface of the stub in intimate contact with a surface of the body and the stub adapted with a spring to flex and prevent damage to the body from expansion of the stub when subjected to a temperature differential.

6 Claims, 1 Drawing Figure

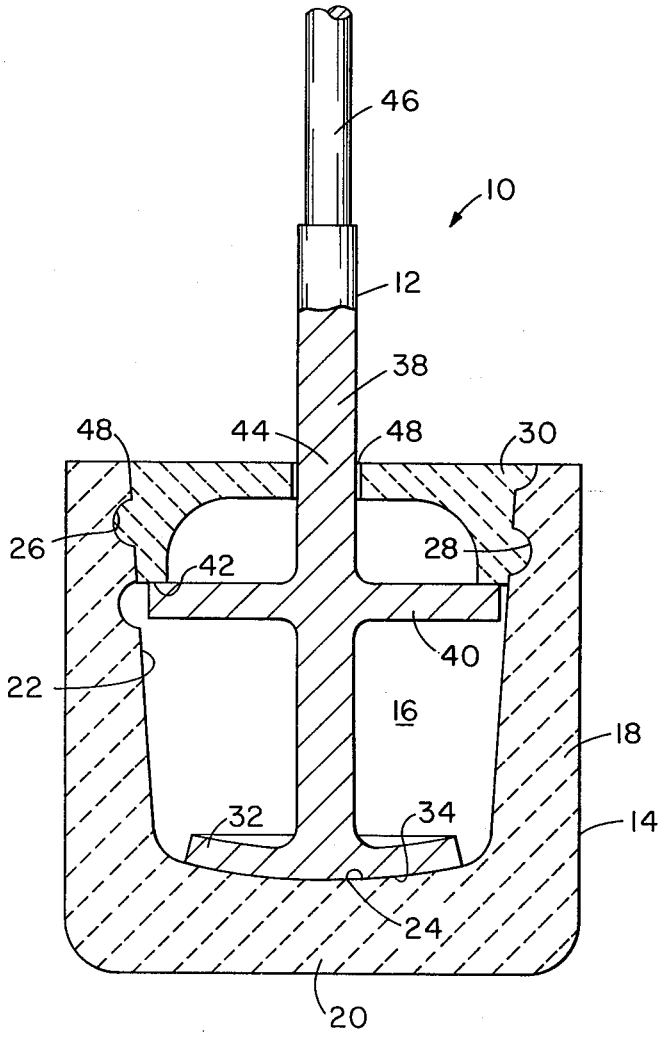
46
10
12
38
48
44
48
30
26
42
28
40
22
16
18
32
34
14
24
20

METAL SPRING STUB AND CERAMIC BODY ELECTRODE ASSEMBLY

The Government has rights in this invention pursuant to Agreement No. DE-FC07-80CS40158 awarded by the U.S. Department of Energy.

BACKGROUND OF THE INVENTION

This invention relates to a method of connecting a metallic electrical conductor to an electrically conductive ceramic electrode body to make an electrode assembly which is suitable for use in producing metal by electrolysis.

A number of materials including metals such as aluminum, lead, magnesium, zinc, zirconium, titanium and silicon, for example, can be produced by electrolytic processes. Although individual processes may vary in some respects from one to another, each employs the use of an electrode which must operate in a highly corrosive environment.

An example of such a process for the production of metal is the well-known Hall-Heroult process (hereinafter referred to as the Hall process) for producing aluminum in which alumina dissolved in a molten fluoride salt bath is electrolyzed at temperatures from 900° C. to 1000° C. In the process as generally practiced today, carbon is used as an anode to reduce the alumina, and the reduction produces molten aluminum, and the carbon is oxidized to primarily form $CO_2$ which is given off as a gas. Despite the common usage of carbon as anode material in practicing the Hall process, there are a number of disadvantages to its use.

Since carbon is consumed in relatively large quantities in the Hall process, approximately 420 to 550 kg per ton of aluminum produced, the anode must be constantly repositioned or replenished to maintain the proper spacing with the cathode in the cell to produce aluminum efficiently. If prebaked anodes are used, it may be seen that a relatively large facility is needed to produce sufficient anodes to operate an aluminum smelter. Furthermore, to produce the purity of aluminum required to satisfy primary aluminum standards, the anode must be relatively pure carbon, and availability and cost of raw materials to make the carbon are of increasing concern to aluminum producers.

Because of the disadvantages inherent in the use of carbon as an anode, there has been a continuing search for inert or nonconsumable materials that can operate as an anode with a reasonable degree of electrochemical efficiency and withstand the high temperature and extremely corrosive environment of the molten salt bath. A number of different types of materials have been suggested and tried, including ceramic oxides, metals and ceramic transition metal borides and carbides, and gaseous fuels, such as natural gas or hydrogen, as the reactant in a fuel-cell type anode. From published literature, few, if any, materials tried will survive for a prolonged time in an aluminum electrolysis cell; however, some ceramic oxides have been reported to be corrosion resistant during cell operation. A recent review of literature and patents relating to inert anodes for use in producing aluminum may be found in articles entitled "Inert anodes for aluminum electrolysis in Hall-Heroult cells (I)" by Kari Billehaug and H. A. Oye, Volume 57, #2, *Aluminium,* 1981, and "Inert anodes for aluminum electrolysis in Hall-Heroult cells (II)" by Kari Billehaug and H. A. Oye, Volume 57, #3, *Aluminium,* 1981.

A major problem in the development and use of nonconsumable anodes for producing aluminum by electrolysis has been that of providing a satisfactory method for making a connection between an electrically conductive ceramic material and a metal conductor leading from the cell to a power source. In a typical operation of a Hall cell using carbon as the anode, the anode is formed into a block having a rectangular cross section and a metallic rod or bar is embedded therein by providing a hole in the block, inserting the rod in the hole and filling the void between the rod and the block with molten iron. When the iron solidifies, it shrinks tightly around the bar and away from the hole surfaces of the carbon block, but disengagement is prevented by adapting the block so as to engage the solidified iron. Such an adaptation is providing recesses in the hole side wall, for example. When the above-described assembly is positioned in a Hall cell having a salt bath which is maintained at approximately 1000° C., the rod, cast iron and carbon in the connection zone rise in temperature from room temperature to approximately 700° to 800° C. The rod, cast iron and carbon in the connection zone expand due to this temperature rise and a substantially tight and reasonably efficient electrical connection is effected. Because the rod and cast iron are relatively free to expand longitudinally, the principal electrical contact between the body and the metal due to the thermal expansion is along the lateral surfaces.

When ceramic materials are used for anode bodies, however, such a connection is not satisfactory for a number of reasons.

When using carbon as the anode body, it is desirable that it be in a block form because it is consumed during the electrolytic process and a large block or mass minimizes the frequency with which anodes must be replaced. It is not desirable, on the other hand, to provide an anode of ceramic materials in a large mass or block because, typically, ceramic anode bodies are more expensive to make than are carbon anode bodies, and the carbon materials are typically better conductors of electricity than are ceramic materials used in inert anodes.

As has been previously noted, the carbon anode to metal bar connection utilizing cast iron as the connecting medium relies primarily upon the lateral surfaces of the cast iron being in substantially tight contact with the lateral surfaces adjacent the hole in the carbon block to effect a reasonably satisfactory electrical connection. Variations in electrical conductivity of such a connection due to such things as irregularities in the cast iron and carbon block surfaces, for example, may be tolerated because of the relatively short time span over which an individual carbon block functions as an anode. In the case of an anode made from ceramic materials, however, most of the ceramic materials which are suitable for use as anodes are less efficient electrical conductors than carbon and, furthermore, to be effective, the anode must function over an extended period of cell operation time. Assuring a continuous intimate contact between the ceramic anode body and metal conductor is considered to be more critical, therefore, than the contact required between a carbon block and metal conductor.

Ideally, the connection of a nonconsumable anode material to a metal conductor for use in the electrolytic production of metal must be corrosion resistant, have a minimal voltage drop across the connection, and function to maintain the integrity of the ceramic material when subjected to temperature differentials on the order of 1000° C.

A number of methods for making connections of ceramic materials to metal conductors in the electrolytic production of aluminum have been proposed. Klein U.S. Pat. No. 3,718,550 proposes three different methods. In one of the methods, a ceramic anode tube, having a closed end, contains molten silver and a titanium carbide rod connected to a current supply extends down into the molten silver pool. In a second method, the inner surface of the tube is covered with a thin layer of silver or platinum and a hollow cylinder of nickel-alloy wire mesh is inserted into the tube to contact the silver or platinum layer and is connected with nickel-alloy wires to a conductor leading to the current supply. In the third method, the closed-end ceramic anode tube contains nickel powder, and a rod of zirconium diboride connected to a conductor leading to the current supply is inserted into the nickel powder. Alder U.S. Pat. No. 3,960,678 shows ceramic anode bodies of various shapes in contact with the electrolyte. Adjacent to the anode, but not in contact with the electrolyte, is a material designated as a current distributor which may be a metal such as Ni, Cu, Co, Mo or molten silver or a nonmetallic material such as a carbide, nitride or boride. Power leads connected to the current distributor may be made of the same materials, and it is suggested that the current distributor and power lead may be a single piece. The patentee does not describe how the various connections are to be made. De Nora et al U.S. Pat. No. 4,187,155 suggests attaching lead-in connectors to ceramic electrodes by fusing the connector into the electrode during the molding and sintering process or by making an attachment after sintering, but does not describe any method for making such attachments so as to avoid fracture of the ceramic in use.

It would be desirable, therefore, to provide a method for joining a ceramic body to a metal conductor for use in producing metal by electrolysis.

SUMMARY OF THE INVENTION

This invention is for an electrode assembly of a ceramic electrode body and a metal stub which is suitable for use in producing metal by electrolysis. The invention provides for a metal stub to be mechanically connected within an opening of a ceramic electrode body in a manner that the metal stub has a surface in tight intimate contact with a surface of the electrode body to provide optimum electrical conductivity through the connection, and the stub has a spring-like portion to permit expansion of the stub without fracturing, cracking or otherwise damaging the ceramic body.

The ceramic electrode body may be comprised of any materials that are suitable for making a ceramic body which is electrically conductive and resistant to corrosion in an environment of its intended use.

The metal stub may be comprised of any electrically conductive metal or metals which are compatible and nonreactive with the ceramic electrode body in the environment of the intended use of the electrode assembly.

It is an object of this invention to provide an electrode assembly of a ceramic anode body and a metal stub for use in producing a metal by electrolysis which is a reliable, electrically efficient connection and accommodates expansion of the stub without damaging the ceramic body.

This and other objects and advantages of the invention will be more apparent with reference to the following description of a preferred embodiment and accompanying drawing.

BRIEF DESCRIPTION OF THE DRAWING

The sole FIGURE is a cross section of an elevation view of an electrode assembly of this invention.

DESCRIPTION OF A PREFERRED EMBODIMENT

For convenience purposes, a description of a preferred embodiment of this invention will be made with reference to producing aluminum by an electrolytic process, but the scope of the invention is not limited to the production of metals.

In the sole FIGURE an anode assembly 10 of this invention is comprised of a metal stub 12 and an electrically conductive ceramic anode body 14. The anode body 14 is provided with an opening 16 and is a generally cylindrical closed end tube having a generally cylindrical side wall 18 and a circular bottom end wall 20. The interior side wall surface 22 of the body is tapered for convenience in molding and the interior bottom end wall surface 24 is curved to optimize surface contact between the anode body 14 and metal stub 12. It is apparent that the geometry of these surfaces, as well as the shape and configuration of the anode body 14, is a matter of choice so long as an opening is provided in the body to accommodate a metal stub. Near an upper portion of the interior side wall surface of the body 14, a continuous recess 26 is provided to engage a continuous thread 28 on a retainer cover 30.

The metal stub 12 is comprised of a disc portion 32 having a bottom surface 34 contoured to provide uniform contact with the interior surface 24 of the anode bottom end wall 20. To further insure uniform contact of the surfaces 34, 24, the surfaces should be smoothed to a relatively fine uniform finish, such as a 30 RMS finish, for example. The diametrical extent of the disc 32 should be the maximum allowable without allowing contact with the side wall 18 upon expansion of the disc from an approximate 1000° C. temperature differential. It is desirable to provide the largest possible diameter for the disc 32 to make the distribution of current to the bottom end wall 20 as uniform as possible.

A metal conductor rod 38 extends upwardly from a central portion of the disc 32. Intermediate the disc 32 and the entrance to the opening 16 in the anode body 14, a spring element 40 extends radially from the longitudinal axis of the rod 38. Preferably, the spring element 40 is of a disc shape to provide the most desirable spring characteristic in the assembly and its radial extent should be limited to a distance which avoids contact with the anode body side wall 18 from expansion of the disc when the assembly is subjected to a temperature differential of approximately 1000° C. The retainer cover 30 is provided with an annular bearing surface 42 to contact the spring element 40 when the cover is threadably engaged with the anode body 14.

To assemble the anode assembly 10, the stub 12 is positioned in the opening 16 of the anode body 14. The retainer cover 30 is slipped over the rod 38 through a central opening 44 in the cover and is threadably engaged with the anode body 14. The cover 30 is screwed down a sufficient distance to bring the bearing surface 42 in contact with the spring element 40 and provide a relatively tight contact between the stub bottom surface 34 and the interior bottom surface 24 of the anode body 14. It may be seen that as temperature of the assembly 10 rises and the stub 12 tends to expand vertically, the bearing surface 42 of the cover 30 exerts increasing pressure on the spring 40 which causes the spring to deflect and desirably maintain a tight uniform contact between the bottom stub surface 34 and interior bottom anode surface 24. As noted earlier, the spring element 40 is preferably disc-shaped. It may be seen that the spring element 40 could be a plurality of arms extending radially outward from the rod 38. In either event, the spring element 40 should be dimensioned and adapted to be rigid enough to maintain a tight uniform contact between the stub 12 and anode body 14 along their contact surfaces 34, 24 and yet be flexible enough to yield and prevent application of pressures of a magnitude which might crack, fracture or otherwise damage the anode body 14. By making the spring element 40 a disc shape, it may be seen that pressure is applied uniformly around a continuous peripheral portion of the disc. On the other hand, if the element 40 were a plurality of arms, the arms would of necessity need to be made thicker than if the element were disc-shaped to provide the desired combination of flexure and rigidity necessary to accomplish the purposes of this invention. It is believed that a thinner disc-shaped element provides greater sensitivity in attaining the desired flexure and rigidity feature.

Insofar as materials of this preferred embodiment are concerned, the ceramic anode body 14 is comprised of 20% by weight Fe, 60% by weight NiO and 20% by weight $Fe_3O_4$. The body 14 is prepared by mixing the above materials and placing them in an appropriate mold and reaction sintering the shaped body in an argon or other inert gas atmosphere at a temperature of approximately 1275° C. for four hours while under a pressure of 25,000 psi (172 MPa).

The metal stub 12 and spring element 40 may be any electrically conductive metal, such as nickel alloy 200, for example, that is compatible and nonreactive with the anode body 14 at the operating temperature and environment of producing aluminum by electrolysis. The stub 12 and spring element may be made in one piece such as by casting or machining from stock, for example, or may be assembled from convenient components.

The retainer cover 30 is preferably made from the same composition of materials as the anode body but may also be made from any other materials which have relatively the same expansion and contraction characteristics as the anode body and which are resistant to corrosion in an electrolytic cell environment.

Prior to using the anode assembly in an electrolytic cell, a metal power lead 46 is attached to the stub and seams 48 are preferably sealed with a material such as a powder of the same material used in making the anode or retainer cover, for example.

The anode assembly 10 is then suspended in a cell containing a bath of 80.7% by weight cryolite, 12.4% by weight $AlF_3$, 5.0% by weight $CaF_2$ and 1.9% by weight $Al_2O_3$. The assembly is suspended by clamping or otherwise attaching the free end of the power lead to an overhead support structure, such as a bus bar, for example. Preferably, the assembly is suspended with the upper surface of the anode body and retainer cover above the bath level to guard against entry of the bath into the anode body opening. In operating the cell to produce aluminum, the temperature is maintained at approximately 960° C., the anode-to-cathode distance is 1.5 inches (38 mm) and the current density is 1 amp/cm$^2$ (6.5 amps/in$^2$).

While the invention has been described in terms of preferred embodiments, the claims appended hereto are intended to encompass all embodiments which fall within the spirit of the invention.

What is claimed is:

1. An electrode assembly, comprising:

an electrically conductive electrode body having an opening therein;

a metal stub having at least one surface in intimate contact with at least one electrode body surface within the opening;

retainer means to retain said stub within the electrode body opening; and spring means to enable said stub to expand from application of a temperature differential without damaging said electrode body.

2. An assembly as claimed in claim 1 wherein said retainer means is a cover adapted to cover the opening in said body and having an opening therethrough to accommodate a portion of said stub projecting through the cover, and the cover further having a bearing portion in intimate contact with said spring means with the cover engaged with said body by engaging means.

3. An assembly as claimed in claim 2 wherein the engaging means is a thread projecting outwardly from a peripheral portion of said cover in engagement with a corresponding recess in a side wall defining the opening in said body.

4. An assembly as claimed in claim 1 wherein said metal stub includes a substantially vertical rod and said spring means is a disc coaxially disposed around a longitudinal axis of the rod portion of said stub.

5. An assembly as claimed in claim 1 wherein said metal stub includes a substantially vertical rod and said spring means is a plurality of arms projecting outwardly and radially from a longitudinal axis of the rod portion of said stub.

6. An electrode assembly, comprising:

an electrically conductive electrode body having a cylindrical opening therein and a spiral recess in an upper portion of the interior wall surface of the body defining the opening;

a metal stub within said electrode opening, the stub comprising a disc portion having a bottom surface in intimate contact with an interior bottom surface of said electrode body defining the opening in said electrode body, a metal conductor rod projecting upwardly from a central portion of said disc portion, and a spring portion projecting outwardly and radially from a longitudinal axis of said conductor rod; and a threaded retainer cover having a central opening therethrough to accommodate the rod of said stub, and said cover also having a bearing surface in intimate contact with an upper surface of the spring portion of said stub with said cover threadably engaged with the recess of said electrode body.

* * * * *